US005335796A

United States Patent [19]

Sanford et al.

[11] Patent Number: 5,335,796

[45] Date of Patent: Aug. 9, 1994

[54] GREETING CARD HOLDER

[76] Inventors: B. Kenneth Sanford; Penelope E. Sanford, both of 222 Glenstone Cir., Brentwood, Tenn. 37027

[21] Appl. No.: 72,557

[22] Filed: Jun. 7, 1993

[51] Int. Cl.[5] ..... A47F 7/00

[52] U.S. Cl. ..... 211/45; 40/124

[58] Field of Search ..... 211/45; 40/124

[56] References Cited

U.S. PATENT DOCUMENTS

| | | | |
|---|---|---|---|
| 2,913,843 | 11/1959 | Wittick | 211/45 |
| 2,951,303 | 9/1960 | Hovlid | 211/45 X |
| 3,144,941 | 8/1964 | Niino | 40/124 |
| 3,170,260 | 2/1965 | Parker | 40/124 |
| 3,293,783 | 12/1966 | Rosenfeld | 40/61 |
| 3,789,526 | 2/1974 | Lavinson | 40/124 |
| 3,791,651 | 2/1974 | Barnum et al. | 40/124 |
| 3,998,334 | 12/1976 | Smith | 211/45 |
| 4,852,280 | 8/1989 | Beattie | 40/124 |

*Primary Examiner*—Alvin C. Chin-Shue
*Assistant Examiner*—Sarah A. Lechok
*Attorney, Agent, or Firm*—Mark J. Patterson; Edward D. Lanquist, Jr.; I. C. Waddey, Jr.

[57] ABSTRACT

The present invention discloses a greeting card holder having a base and a top joined by support. Around the support there are placed plural rods which are received by the base at one end and the top at the other. The greeting cards are placed initially in between any two of the rods with the end of the greeting card being deflected by the support to come back such that the spine of the card resides along one of the rods. Rods are sufficiently flexible so that they may be temporarily bent to allow placement of the cards yet sufficiently rigid so that the cards have consistent spacing thereby preventing bunching of the cards along their respective spines.

7 Claims, 3 Drawing Sheets

GREETING CARD HOLDER

BACKGROUND OF THE INVENTION

The present invention relates generally to greeting card displays and holders and more particularly to a holder for storing and displaying greeting cards along their spines.

It will be appreciated by those skilled in the art that many individuals like to keep holiday and personal greeting cards that they might receive as remembrances. Quite often these cards end up in storage boxes from which they must be removed in order to be viewed or displayed.

One attempt at overcoming the problems of the early prior art is described in U.S. Pat. No. 3,789,526 issued to B. Lavinson on Feb. 5, 1974. Unfortunately, Lavinson relies upon a cord which can be broken causing the entire display to be ineffective. Further, the lack of rigidity of a loose cord prevents the spacing which is needed to have an effective display thereby necessitating the need for horizontally extending ledges and protuberances. The extreme rigidity of a taut cord makes it difficult to place cards in the holder and increases the likelihood that the cord will break if pulled too tightly when placing a card in the holder or removing a card from the holder.

U.S. Pat. No. 3,170,260 issued to D. Parker on Feb. 23, 1965, discloses a vertical greeting card display. Although this device does store the greeting card along its spine, it would occupy a large amount of space to store many cards and would not be effective to store several greeting cards on the same horizontal plane.

U.S. Pat. No. 3,293,783 issued to H. Rosenfeld on Dec. 27, 1966, discloses a greeting card display which is intended for use with a single card.

Similarly, U.S. Pat. No. 3,791,651 issued to D. Barnum, et al on Feb. 12, 1974, discloses a device for vertical storage which allows a limited number of greeting cards to be displayed.

What is needed, then, is a device for effectively holding and displaying numerous greeting cards in a relatively small space. This needed device must be sufficiently rigid to allow effective spacing of the greeting cards yet still be flexible for easy insertion and removal of the cards. This holder must be rotatable and position the cards so that they can be easily viewed in their entirety. This greeting card holder must also aesthetically complement the owner's decor. This device is presently lacking in the prior art.

SUMMARY OF THE INVENTION

The present invention discloses a greeting card holder having a base and a top joined by support. A plurality of rods are attached to the base and top of the holder and are positioned around and in substantial vertical alignment with the support. Greeting cards, one for each rod, are positioned such that the inner spine of each card abuts one of the rods, with the viewable surfaces of the cards extending outwardly from the holder. The rods are semi-rigid so that they may be temporarily bent to allow placement of the cards yet promote consistent spacing of the cards, thereby preventing bunching of the cards along their respective spines.

Accordingly, one object of the present invention is to provide a holder for storing and displaying greeting cards in a small space.

Another object of the present invention is to provide a storage medium which is capable of receiving cards along their spine and rigid enough to allow proper horizontal spacing of the cards.

Still another object of the present invention is to provide a holder which is aesthetically pleasing.

DESCRIPTION OF THE PREFERRED EMBODIMENT

Referring now to FIG.'s 1, 2, and 3 there is shown generally at 10 the greeting card holder of the present invention. Holder 10 has a generally circular rotating base 12 joined to a top 14 by a centrally positioned elongated cylindrical support 16. A plurality of rods 18 extend between base 12 and top 14 in substantial vertical alignment with support 16.

Figure 3:
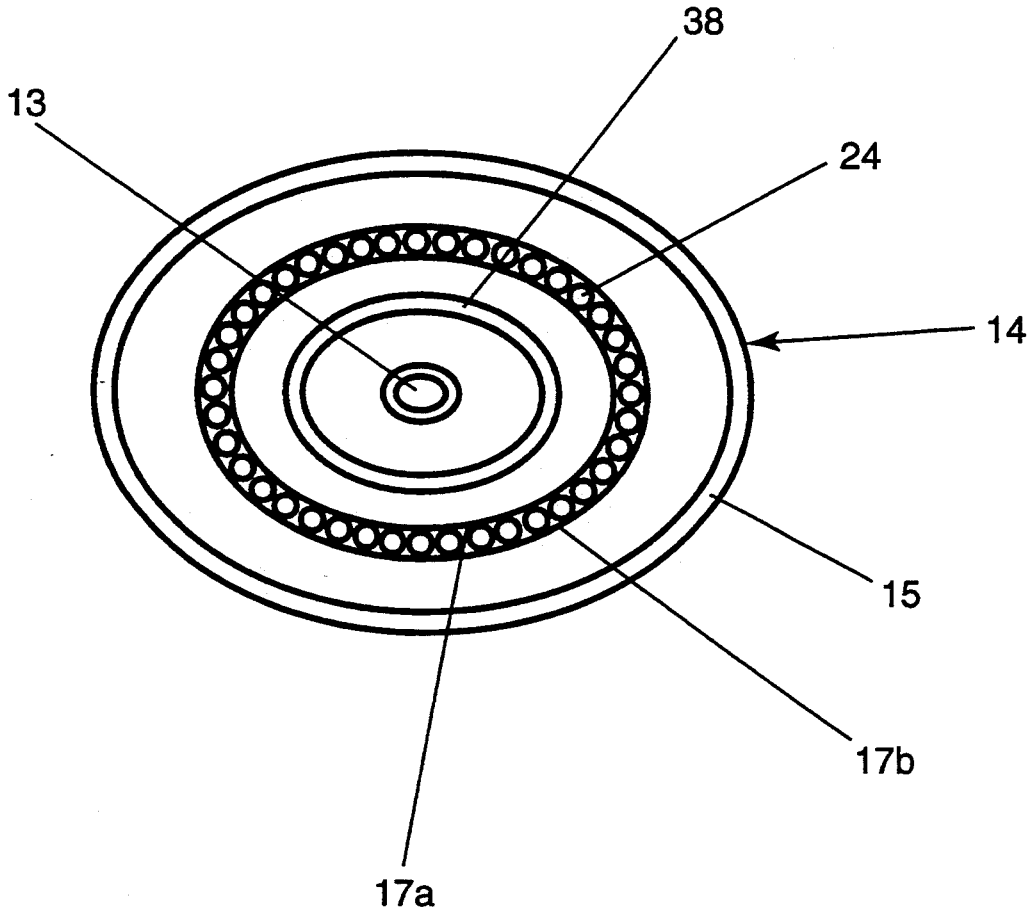
FIG. 3 is a plan view looking from the underside of the top of the present invention.

Top 14 includes a circular shroud member 15 with integral knob 13 extending vertically therefrom. A pair of spaced circular walls 17*a* and 17*b* attach to and descend downwardly from below shroud member 15. Preferably, walls 17 are shorter than the vertical surface of shroud 14 so that walls 17 are ordinarily concealed from view. A series of equally spaced circular ridges (FIG. 3) are placed between walls 17 to define a plurality of upper cylindrical cavities 24 to receive the upper ends of rods 18. A circular ridge 38 also extends below shroud member 15 to frictionally abut and position the inner surface of support 16.

Base 12 also has a shroud member 19 with a plurality of holes 26 through its horizontal surface, creating a circular pattern around support 16 to receive and retain the lower ends of rods 18. A ledge 21 is joined to and extends below shroud 19 to establish a supporting floor for rods 18. Circular ridge 39 extends upwardly from shroud 19 to frictionally receive support 16 in a central position abutting base 12. An optional part of base 12 is turntable unit 40, including bearing 42, which supports holder 10 and allows it to rotate in a conventional manner for ease of viewing. The diameter of base 12 will preferably be greater than the diameter of top 14 so as to give stability to holder 10 while allowing good visibility of cards 20 from above.

Cavities 24 in top 14 and holes 26 in base 12 are spaced and positioned such that each rod 18 can be retained perpendicularly with respect to base 12 and top 14. In the preferred embodiment, there are 48 each of cavities 24 and holes 26, corresponding to 48 rods 18. Further, in the preferred embodiment, each cavity 24 and hole 26 has approximately a 3/32" diameter. Rods 18 are made of 1/16" inch diameter wire so that they will loosely fit within cavities 24 and holes 26. The total height of holder 10 is preferably approximately 11 ¾". Rods 18 are approximately 10 13/16" long and preferably are of a length that permits some vertical movement within cavities 24 and holes 26.

Figure 1:
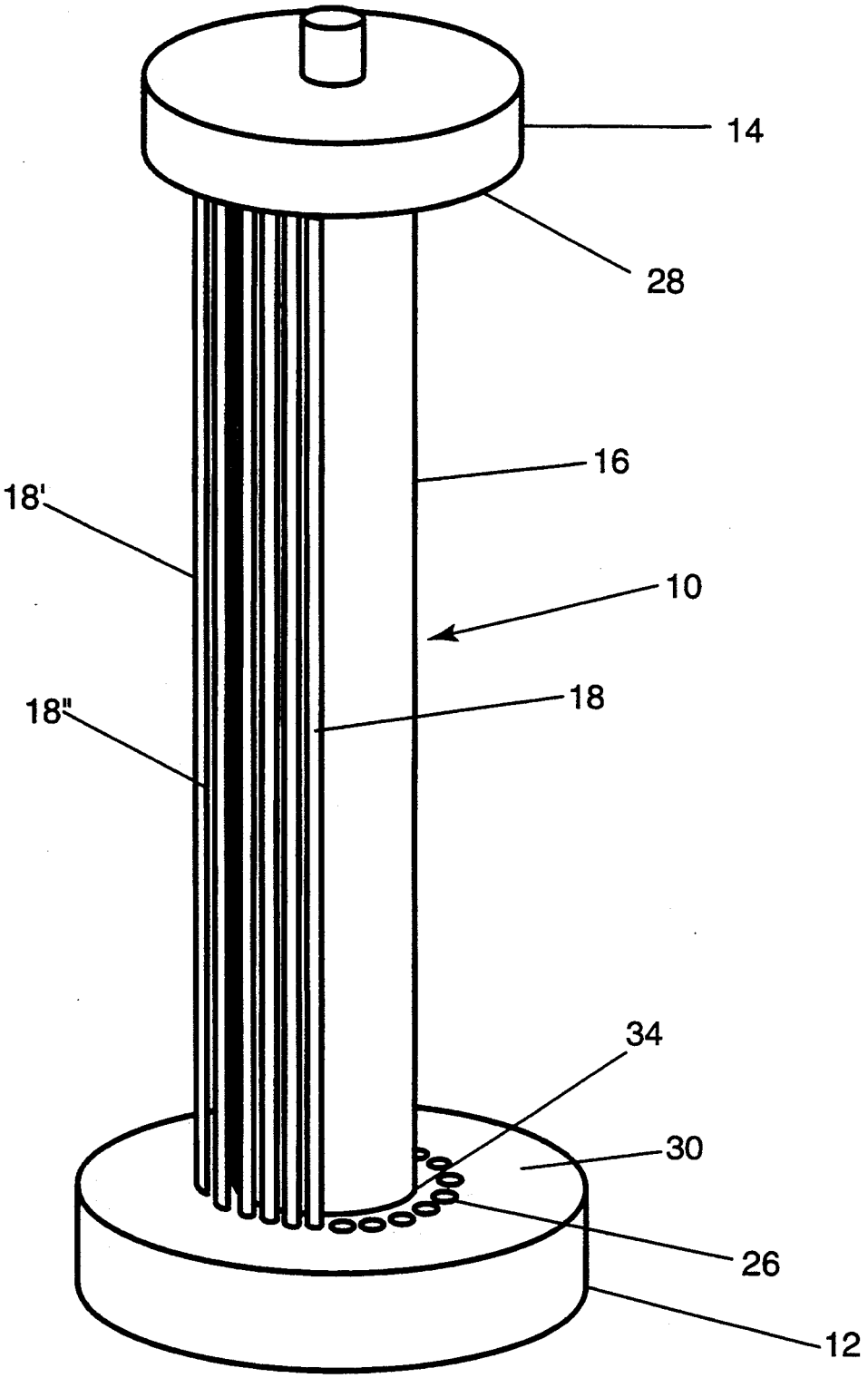
FIG. 1 is a perspective view of the greeting card holder of the present invention in which some of the rods have been removed to show the support.
Figure 2:
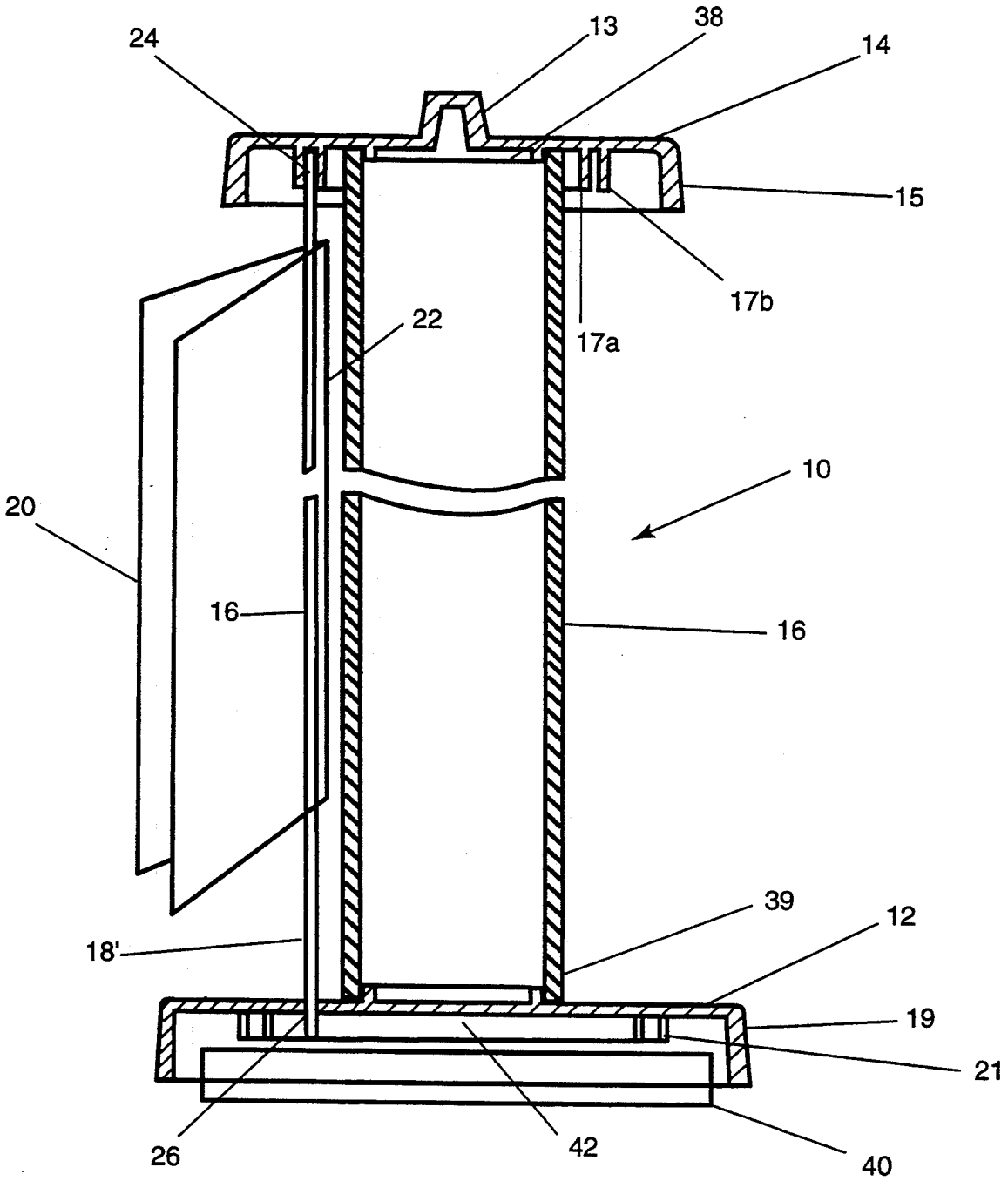
FIG. 2 is a side view of the greeting card holder showing the interaction between the greeting card spine and the rods.

Referring now to FIG. 2, the interaction between a greeting card 20 and holder 10 can be seen. One marginal end of greeting card 20 is placed between any two adjacent rods 18', 18''. The card 20 then contacts support 16 which deflects card 20 to the other side of rod 18' until spine 22 of greeting card 20 is placed proximate to and in substantial vertical alignment with rod 18'. Rods 18 are semi-rigid to maintain spacing between adjacent greeting cards but with flexibility to allow an individual to pull rod 18 away from support 16 for placement of greeting cards 20. After each greeting 20 card is placed, its corresponding rod 18 returns to its original position and spacing. Each card 20 is now oriented such that its inside and outside text and surface decoration on both the front and rear pages can be viewed with little or no manipulation by the viewer. The aesthetic effects can be enhanced by forming support 16 out of clear plastic.

In the preferred embodiment, all parts of holder 10 except rods 18 can be molded out of plastic in conventional fashion.

Thus, although there have been described particular embodiments of the present invention of a new and useful holder for displaying greeting cards, it is not intended that such references be construed as limitations upon the scope of this invention except as set forth in the following claims. Further, although there have been described certain dimensions used in the preferred embodiment, it is not intended that such dimensions be construed as limitations.

What is claimed is:

1. A holder for greeting cards comprising:

a. a base;

b. a top;

c. a support attached to said base and supporting said top above said base; and d. plural flexible and semi-rigid rods connected to said base and said top in substantial vertical alignment with said support, each of said rods adapted to retain the spine of said greeting cards in a vertical position, whereby the front and rear pages of said greeting cards extend outward radially from said holder.

2. The holder of claim 1, said rods comprising semi-rigid elongated cylinders.

3. The holder of claim 2 further comprising means to rotate said holder.

4. The holder of claim 3 whereby said rods are equally spaced in a circular pattern around said support.

5. The holder of claim 4, said top comprising a shroud member and a plurality of cavities extending below and visually shielded by said shroud member, said cavities adapted for receiving one end of each of said rods.

6. The holder of claim 4, said base comprising a shroud, a plurality of holes through said shroud, and ledge means for supporting said rods, said ledge means attached to said shroud below said holes.

7. A holder for greeting cards comprising:

a. a base;

b. a top;

c. a support attached to said base and supporting said top above said base;

d. plural flexible and semi-rigid rods connected to said base and said top in substantial vertical alignment with said support, each of said rods adapted to retain the spine of said greeting cards in a vertical position, whereby the front and rear pages of said greeting cards extend outward radially from said holder; and e. said top comprising a shroud member and a plurality of cavities extending below and visually shielded by said shroud member, said cavities adapted for receiving one end of each of said rods.

* * * * *